United States Patent [19]

Hazenveld

[11] Patent Number: 5,046,649

[45] Date of Patent: Sep. 10, 1991

[54] GARMENT HANGER HAVING COOPERATIVE INTERCONNECTED RESILIENT AND FLEXIBLE MEMBERS

[76] Inventor: Martin G. Hazenveld, Unit 13/8 Wilmette Place, Mona Vale, Sydney NSW 2103, Australia

[21] Appl. No.: 496,578

[22] Filed: Mar. 21, 1990

[30] Foreign Application Priority Data

Mar. 23, 1989 [NL] Netherlands ..... 8900731

[51] Int. Cl.[5] ..... A47G 25/62; A47G 25/66; A47G 25/64; A47G 25/48

[52] U.S. Cl. ..... 223/95; 223/85

[58] Field of Search ..... 223/95, 89, 94, 88, 223/85, 96; D6/315; 211/113

[56] References Cited

U.S. PATENT DOCUMENTS

| | | | |
|---|---|---|---|
| 800,518 | 9/1905 | Wardwell | 223/95 |
| 4,221,310 | 9/1980 | Hazenveld | 223/94 |
| 4,223,817 | 9/1980 | Hazenveld | 223/94 |
| 4,227,632 | 10/1980 | Collis | 223/94 |
| 4,600,132 | 7/1986 | Blanchard | 223/95 |
| 4,923,102 | 5/1990 | Agathangelou | 223/95 |

*Primary Examiner*—Werner H. Schroeder
*Assistant Examiner*—Bibhu Mohanty
*Attorney, Agent, or Firm*—Diller, Ramik & Wight

[57] ABSTRACT

A garment hanger having a base element, a top element and a suspension hook is disclosed. The base element comprises at least one elongated body of resiliently bendable material, such as e.g. a rod of resin-coated spring steel, which has carrying pieces for bearing a garment or other article of manufacture at both its ends. The top element comprises two connecting arms of flexible material, such as e.g. flexible synthetic resin, which are connected to each other or to a rigid central body and which are moreover connected with their ends to the body of the base element at positions located between the center and the ends thereof. With this hanger, garments and the like may be suspended in tensioned state and stored in stands or wardrobes. In a special embodiment, the hanger is provided with an elongated attachment for keeping the garments together.

9 Claims, 3 Drawing Sheets

GARMENT HANGER HAVING COOPERATIVE INTERCONNECTED RESILIENT AND FLEXIBLE MEMBERS

BACKGROUND OF THE INVENTION

This invention relates to a garment hanger which has been devised predominantly for suspending skirts and similar garments in tensioned state but which may also be used with advantage for suspending other articles of manufacture.

A known garment hanger for this purpose, as disclosed in U.S. Pat. No. 4,221,310, has a base element which comprises two upwardly inclined tensioning arms adapted for carrying a garment or other article at their free ends and hingedly connected to each other or to a central body, and a top element which comprises two downwardly inclined connecting arms, having about half the length of the tensioning arms, said connecting arms being hingedly connected to each other or to a central body and moreover being hingedly connected to the tensioning arms at places about halfway from the tensioning arms. Spring means, for instance leaf springs, located at the position of the hinged connections are provided for urging the top element and base element together. The hanger is completed by a suspension hook connected to the top element.

In this known hanger, the tensioning arms together with the connecting arms, will form a quadrangle wherein the angular points are formed by the hinged connections. This provides a firm construction capable of bearing relatively high weights. Further, the spring means present will ensure a high internal resilience causing the tensioning arms to have a permanent tendency to stretch.

During use, the hanger is introduced into a garment with both tensioning arms in raised position, or loops of the garment are engaged to hooks at the free ends of the tensioning arms, whereupon the tensioning arms are released so as to allow them to stretch and to engage the garment under exertion of a tensioning force. The combination of garment and hanger may then be suspended and stored in a stand or wardrobe.

Advantages of this known hanger are that the hanger is capable of bearing relatively high weights, that skirts or other garments can be suspended in tensioned state and that garments of different sizes will be suspended always at the same height with regard to the suspension hook. A disadvantage may be that this known hanger is of relatively complicated construction and that it will need a relatively high amount of material for its manufacture.

SUMMARY OF THE INVENTION

During further research, it has now been found that an improved effectiveness and a simpler construction, while preserving most of the advantages of the known hanger, can be obtained by using an elongated body of resiliently bendable material, said body having carrying pieces at its ends, as a base element of the hanger. In that case, a smaller amount of material is needed and the production costs can be reduced accordingly. Moreover, thanks to the improved effectiveness, new possibilities of variation are offered which were missing in the known hanger.

The invention provides a garment hanger or the like, comprising a base element which comprises at least one elongated body of resiliently bendable material, said body having carrying pieces for bearing a garment or other article of manufacture at both its ends, and a top element which comprises two connecting arms of flexible material connected to each other or to a rigid central body and connected with their ends to the body of said base element at positions located between the center and the ends thereof, and further comprising a suspension hook secured to the connecting point or to the central body of the connecting arms.

By means of this hanger, garments, such as skirts and trousers as well as other articles of manufacture may be suspended in tensioned state, just as in the case of the old hanger. Further, garments of different sizes will be suspended always at about the same height with regard to the suspension hook. In spite of the simple and light weight construction, the hanger is capable to bear relatively high weights. A special advantage is that the hanger may be adapted to the weight of the garments by variation of the resiliency in the base element and that unaesthetic situations in which the hanger rises high above the garment or sinks into the garment can be prevented by variation of the positions where the connecting arms are connected to the base element.

In a special embodiment, an elongated attachment for keeping the garment together is provided at the central body of the connecting arms or at the suspension hook. Additional advantages may be obtained thereby.

The invented hanger will now be described in more detail.

A major component of the invented hanger is the base element which comprises at least one elongated body of resiliently bendable material having carrying pieces at its ends. This base element will provide the hanger with firmness. It can easily be bent and tensioned, thus allowing the hanger to be introduced in compressed state into a garment during use. Further, it will return easily from it compressed state to its initial state and allow the hanger thereby, after introduction into a garment, to exert a tensioning force onto that garment. Thereafter, the combination of hanger and garment may be suspended and stored in tensioned state in a stand or wardrobe.

While several materials may be used for the elongated body of the base element, it is preferred to use a body of spring steel having a corrosion-resistant synthetic resin coating.

The elongated body may be totally straight but alternatively, it has a bent or curved form. In a preferred embodiment, the elongated body is a straight body having upwardly inclined end pieces; this will provide the hanger with favourable tension characteristics, that is a substantially equal tensioning force with the whole group of sizes for which the hanger has been devised.

While the elongated body of the base element may have any desired shape in cross-section, it is preferably round for the sake of cost reduction. Further, the body may have any of several sizes (diameters), dependent from the weight of the garments for which the hanger has been devised.

The carrying pieces at the ends of the elongated body may have any desired shape and size and are preferably of a synthetic resin although other materials can also be used.

While the base element preferably comprises only one elongated body of resiliently bendable material, embodiments having two of such bodies interconnected at their ends and optionally at other places by means of spacers are conceivable.

The top element of the hanger is formed by two connecting arms of flexible material, e.g. flexible synthetic resin, which are connected to each other or to a central body. These connecting arms need only to have a low rigidity because the base element will provide already for sufficient firmness and resiliency. In the case that the connecting arms are nevertheless provided with a certain rigidity, e.g. by means of a cross-profile, it should be made sure that the connections of the arms to each other and to the central body and also the connections of the arms to the body of the base element will remain sufficiently flexible, e.g. by arranging hinges or flexible leafsprings thereto.

The connecting arms are connected with the body of the base element at positions located between the center and the ends of that body. A connection halfway the distance between the center and the ends of the body is not absolutely necessary. This offers a possibility of variation in order to prevent situations wherein the hanger rises high above the garment or becomes buried in the garment during use.

In addition to the parts already mentioned, the invented hanger may comprise further parts or elements which can improve the functioning of the hanger during utilisation. Thus, an elongated attachment for keeping a garment together may be arranged at the central body of the connecting arms or at the suspension hook. Such an attachment may have different shapes as explained in the figure description.

The invention is illustrated by the drawing which shows some embodiments of the hanger and their way of functioning.

DESCRIPTION OF THE PREFERRED EMBODIMENTS

Figure 1:
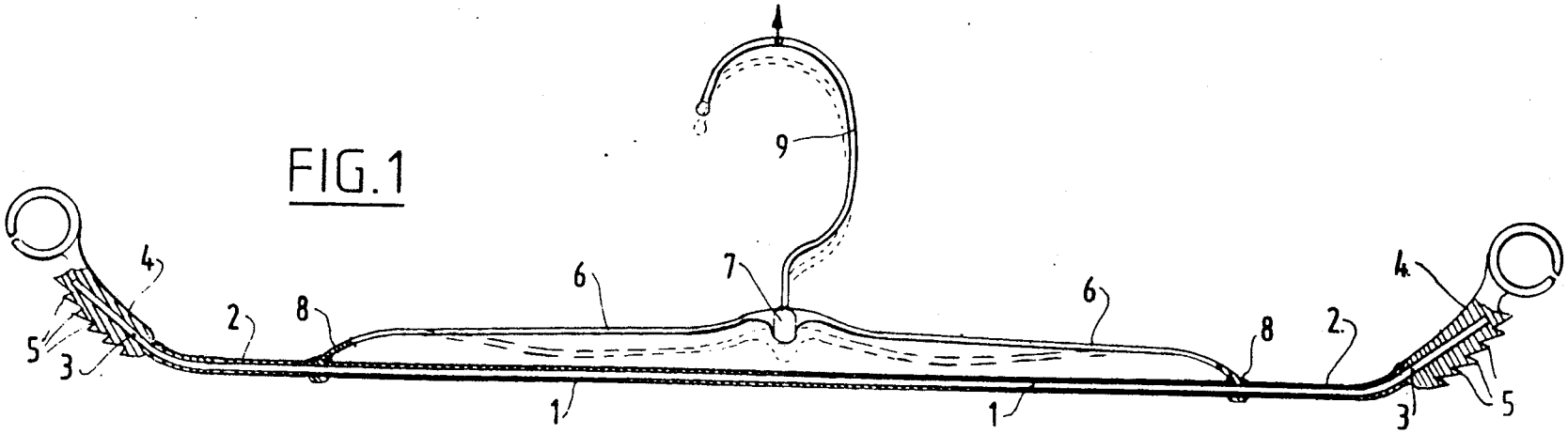
FIG. 1 shows an embodiment of the invented hanger in side view and partially in cross-section; the top element of the hanger has been shown in two positions corresponding to the suspended state of the hanger (full lines) and to the free state of the hanger (dotted lines).

The hanger of FIG. 1 has a base element which comprises an elongated round rod 1 of spring steel surrounded by a corrosion-resistant synthetic resin coating 2. The rod 1 is a straight rod having upwardly inclined end portions 3, 3 provided with carrying pieces 4, 4 of synthetic resin. The carrying pieces are adapted to bear a garment such as a skirt or trousers and are provided with conventional protrusions 5, 5 for this purpose. Further, the hanger has a top element which comprises two connecting arms 6, 6 of flexible synthetic resin connected to a rigid central body 7 and secured with their ends 8, 8 to the rod 1, at positions located between the center and the ends of the rod. The hanger is completed by a suspension hook 9 secured to the central body 7 of the top element.

The connecting arms 6, 6 of flexible synthetic resin have only a low rigidity and will therefore take the positions that have been shown with dotted lines in FIG. 1 when they are in a free state. Only in the suspended state of the hanger, the connecting arms are stretched tightly and this has been shown in FIG. 1 with full lines.

In use, the hanger of FIG. 1 can be easily deformed thanks to the materials constituting rod 1 and connecting arms 6, 6. If, for instance, the hanger is held at the carrying pieces 4, 4 and these carrying pieces are pressed together, the rod 1 will be curved over its entire length and the connecting arms 6, 6 will occupy any random position. A tension is created then in the hanger, thanks to the spring action in rod 1 and this tension will tend to restore the initial state. If the hanger is introduced thereupon into a skirt or other garment and the carrying pieces are released then, the hanger will partially relax under spring action until the carrying pieces have engaged the garment. The combination of hanger and garment may be suspended then in tensioned state and stored in a stand or wardrobe.

Figure 2:
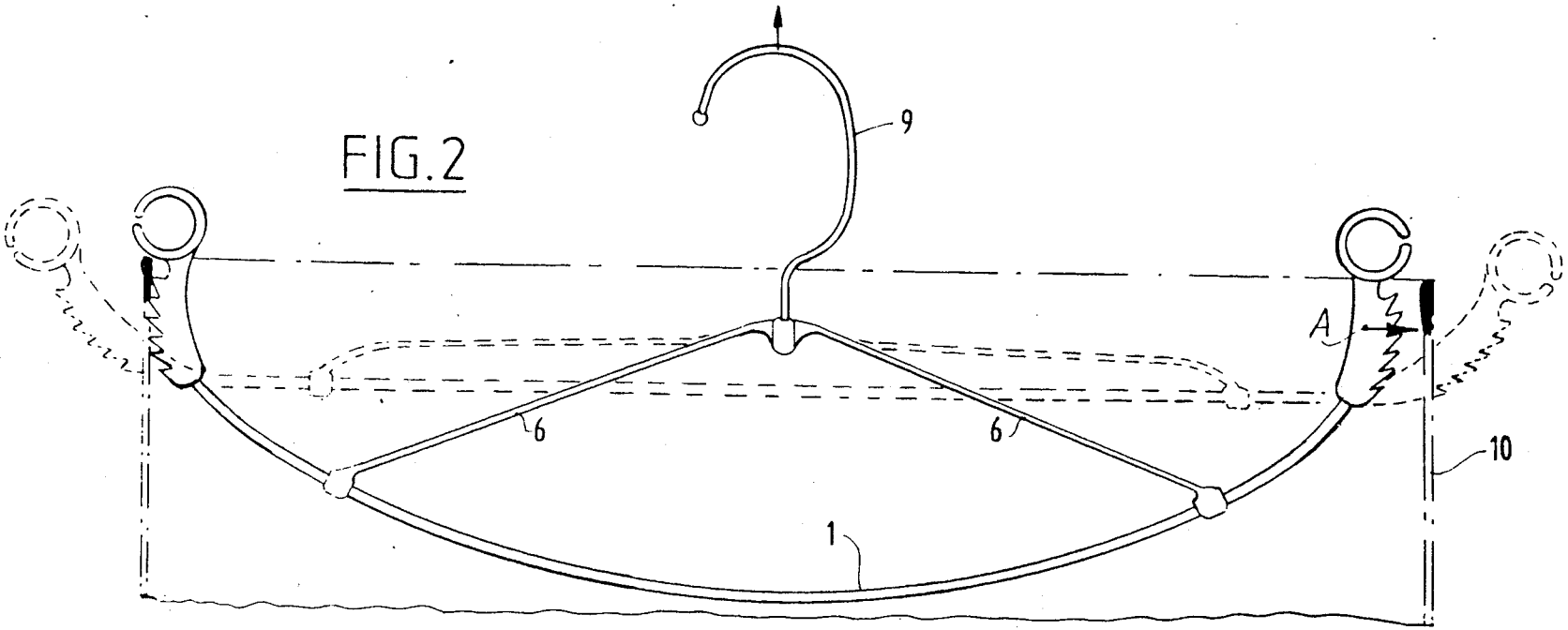
FIG. 2 shows the hanger of FIG. 1 after introduction into a garment (full lines) and in relieved state (dotted lines).

FIG. 2 shows how the hanger in compressed state is introduced into a skirt 10. One of the carrying pieces 4 of the hanger is bearing already against the inner side of the skirt and the other carrying piece 4 is relaxing into the direction of arrow A until it will also bear against the inner side of the skirt. The hook 9 of the hanger is shown in pulled-up position. The initial state of the hanger according to FIG. 1 has been shown here with dotted lines.

A comparison between the two positions of the hanger shown in FIG. 2 (i.e. the positions shown in dotted lines and in full lines, respectively) learns that the rod 1 is curved during use. Moreover, it can be seen that the carrying pieces in both positions will be at substantially the same height with regard to the suspension hook, thanks to the outwardly directed tension in the hanger. This means that garments of different sizes will always be suspended at substantially the same height.

Figure 3:
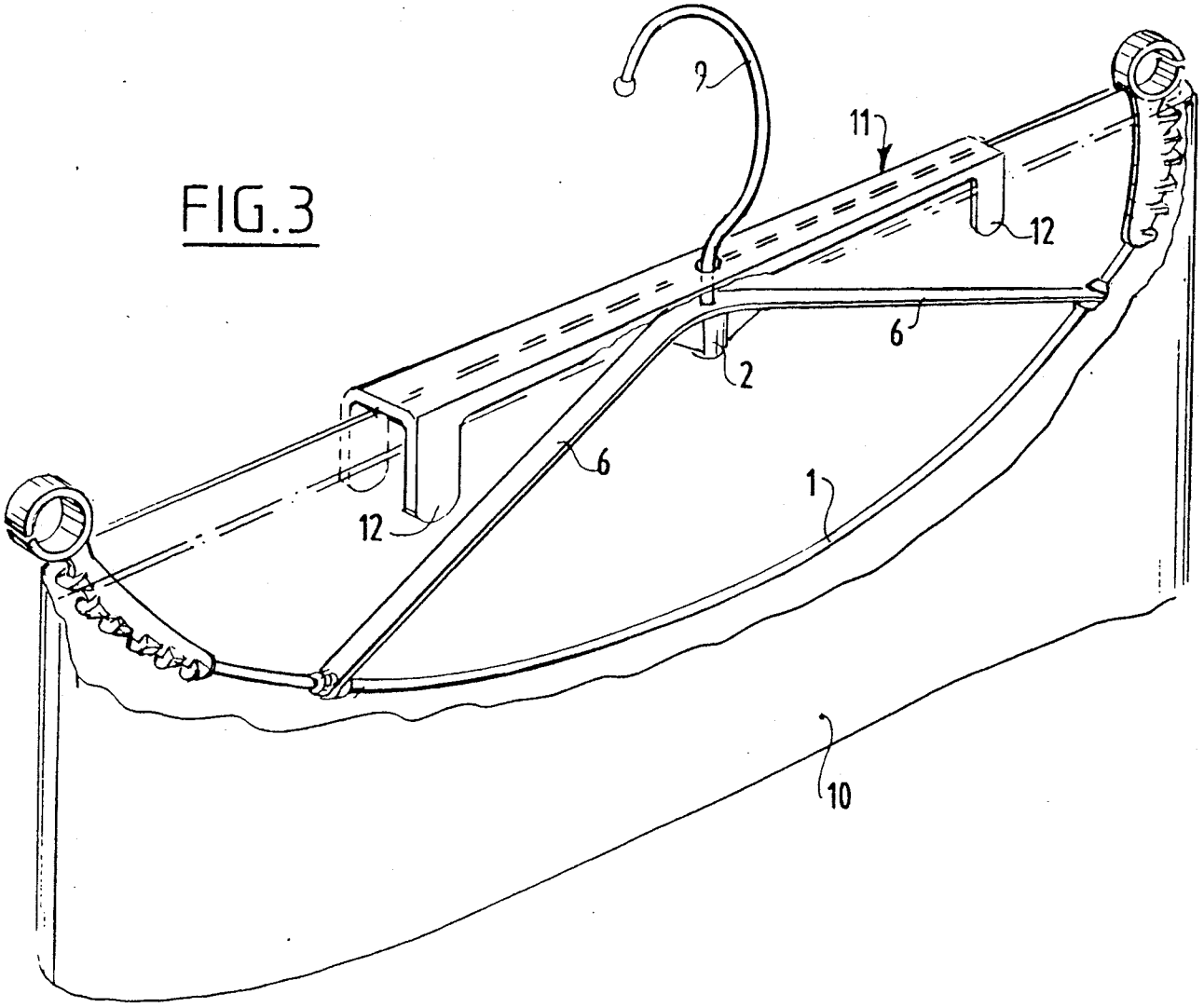
FIG. 3 shows an embodiment similar to that of FIGS. 1 and 2 but provided with an attachment.

FIG. 3 shows a similar hanger as in FIGS. 1 and 2, introduced into a skirt 10 or other garment and provided with an elongated attachment 11 for keeping the garment together. In this figure, the attachment has the shape of an inverted U-profile with four downwardly directed fingers 12, 12 which keep the garment together. An extraordinary large garment might be folded down and clamped under the attachment, if necessary.

Figure 4:
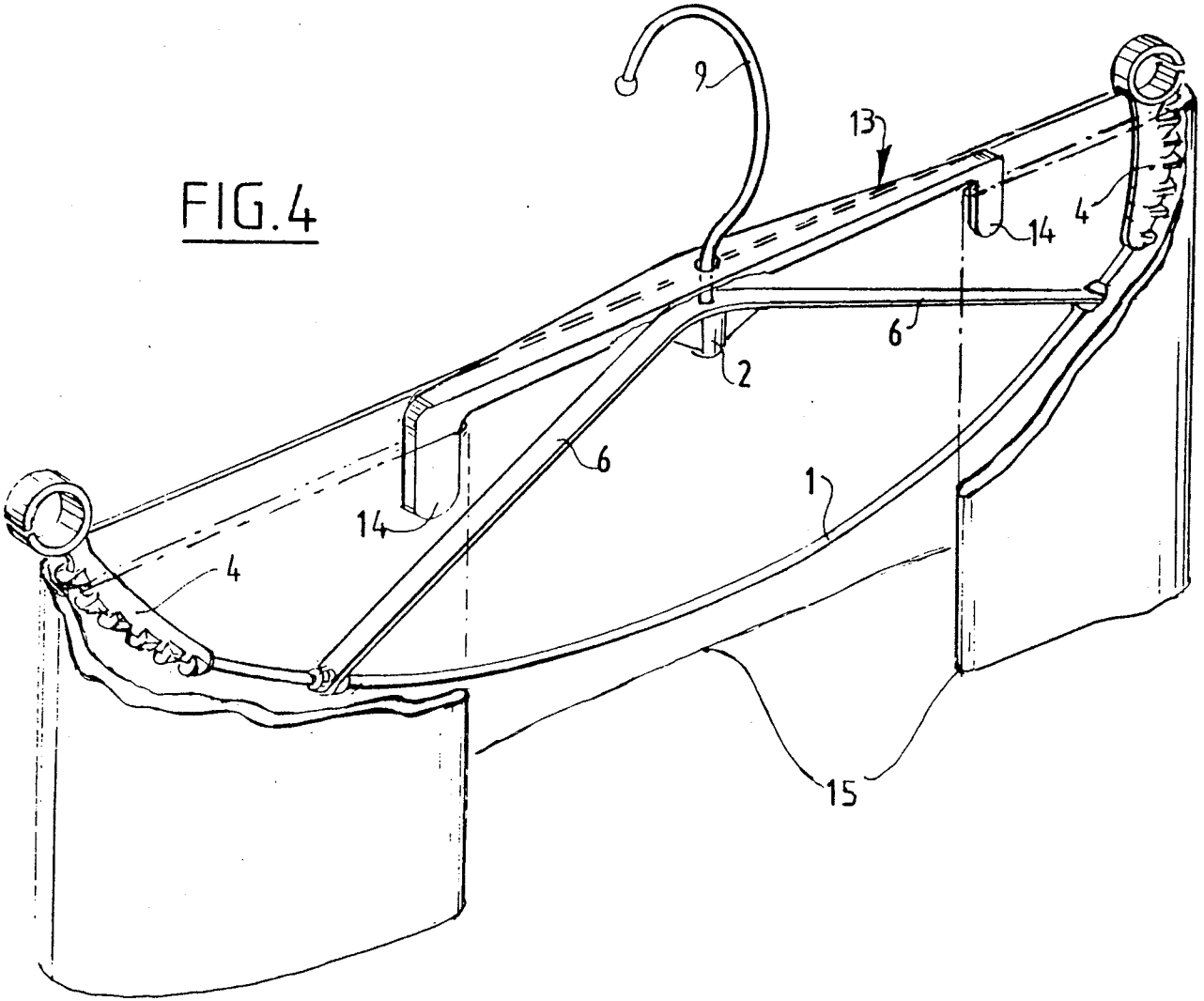
FIG. 4 is a variant to the combination of FIG. 3.

In the variant of FIG. 4, the hanger is of similar type as in FIGS. 1 and 2 and is provided with an attachment 13 in the form of an arm extending to both sides and having two downwardly directed fingers 14, 14. The hanger has been introduced into a wide skirt 15 or other garment which has been folded next and turned down with the ends of its waist bent around the fingers 14, 14 in such a way that these fingers will function here as additional carrying pieces.

Several variants to the embodiments described are possible. Thus, rod 1 in the embodiment of FIGS. 1 and 2 does not necessarily need to have the shape as represented, but it may alternatively be entirely straight or curved or it may be bent at more than two places. In cross-section, this rod may be round but alternatively it may have any other appropriate form. Variation of the thickness of the rod may lead to different values of the spring force therein which are adapted to garments of different weight.

The connecting arms may have any desired shape in cross-section provided that they have been made of a flexible material. Preferably, the material of these connecting arms is of minimum rigidity; in the case of a higher rigidity, hinged connections or perhaps flexible spring connection should be arranged at the connecting places. Variation of the location of the connecting points may serve to prevent situations in which the hanger rises high above the garment or is buried into the garment.

The carrying pieces are preferably made of synthetic resin but may alternatively be composed of any other material.

The attachment may have any desired shape and may carry each desired number of fingers or the like. These fingers may be arranged in an opposite or off-set or adjacent fashion.

While the base element in the represented embodiments of the hanger comprises only one resiliently bendable rod, another embodiment is conceivable wherein two parallel rods arranged one above the other and interconnected by spacers at their ends and optionally at other positions, are present. Such an embodiment will provide the hanger with an improved firmness.

Finally, it will be clear that the invented hanger will not only serve to suspend garments but that it can also be used for suspending other articles of manufacture.

I claim:

1. A garment hanger comprising a base element including an elongated body of resiliently bendable material, said elongated body having a central portion and opposite end portions, means at said opposite end portions for engaging a garment, a top element of flexible material having a central portion and opposite end portions, each top element end portion being disposed between said elongated body central portion and an associated one of said elongated body end portions, means for suspending the garment hanger from an associated support, and elongated attachment means adjacent said top element central portion for augmenting the positioning of a garment engaged by said garment engaging means.

2. A garment hanger comprising a base element including an elongated body of resiliently bendable material, said elongated body having a central portion and opposite end portions, means at said opposite end portions for engaging a garment, a top element of flexible material having a central portion and opposite end portions, each top element end portion being disposed between said elongated body central portion and an associated one of said elongated body end portions, means for suspending the garment hanger from an associated support, said elongated body being spring steel coated with a corrosion-resistant synthetic resin coating, and elongated attachment means adjacent said top element central portion for augmenting the positioning of a garment engaged by said garment engaging means.

3. A garment hanger comprising a base element including an elongated body of resiliently bendable material, said elongated body having a central portion and opposite end portions, means at said opposite end portions for engaging a garment, said elongated body central portion being substantially straight and said opposite end portions being substantially upwardly inclined, a top element of flexible material having a central portion and opposite end portions, each top element end portion being disposed between said elongated body central portion and an associated one of said elongated body end portions, means for suspending the garment hanger from an associated support, and elongated attachment means adjacent said top element central portion of augmenting the positioning of a garment engaged by said garment engaging means.

4. A garment hanger comprising a base element including an elongated body of resiliently bendable material, said elongated body having central portion and opposite end portions, means at said opposite end portions for engaging a garment, said garment engaging means being a synthetic resin carrying piece carried by each of said opposite end portions, a top element of flexible material having a central portion and opposite end portions, each top element end portion being disposed between said elongated body central portion and an associated one of said elongated body end portions, means for suspending the garment hanger from an associated support, and elongated attachment means adjacent said top element central portion for augmenting the positioning of a garment engaged by said garment engaging means.

5. A garment hanger comprising a base element including an elongated body of resiliently bendable material, said elongated body having a central portion and opposite end portions, means at said opposite end portions for engaging a garment, a top element of flexible material having a central portion and opposite end portions, said top element flexible material being a flexible synthetic resin, each top element end portion being disposed between said elongated body central portion and an associated one of said elongated body end portions, means for suspending the garment hanger from an associated support, and elongated attachment means adjacent said top element central portion for augmenting the positioning of a garment engaged by said garment engaging means.

6. A garment hanger comprising a base element including an elongated body, said elongated body having a central portion and opposite end portions, said opposite end portions terminating each at a terminal end, said elongated body being constructed from resilient material entirely along its length between said terminal ends, means at said terminal ends for engaging a garment, an elongated top element having a central portion and opposite end portions, said top element opposite end portions terminating at terminal ends, said elongated top element being constructed from flexible material entirely along its length between said elongated top element terminal ends, each top element end portion being disposed between said elongated body central portion and an associated one of said elongated body terminal ends, and means for suspending the garment hanger from an associated support.

7. The garment hanger as defined in claim 6 including elongated attachment means adjacent said top element central portion for augmenting the positioning of a garment engaged by said garment engaging means.

8. The garment hanger as defined in claim 7 wherein said elongated attachment means is a substantially elongated member having a downwardly directed finger at opposite ends of said elongated member.

9. The garment hanger as defined in claim 7 wherein said elongated attachment means is a substantially elongated member having a pair of downwardly directed fingers at opposite ends of said elongated member.

* * * * *